United States Patent [19]

Jones

[11] Patent Number: 5,003,879

[45] Date of Patent: Apr. 2, 1991

[54] DELAY DETONATOR

[75] Inventor: Ronald G. Jones, Godfrey, Ill.

[73] Assignee: Propellex, Edwardsville, Ill.

[21] Appl. No.: 432,079

[22] Filed: Nov. 6, 1989

[51] Int. Cl.[5] ..... F42C 19/10

[52] U.S. Cl. ..... 102/204; 102/277.1; 102/202.13

[58] Field of Search ..... 102/202.13, 202.5, 202.14, 102/204, 202, 277.1, 322, 205, 275.3, 275.6

[56] References Cited

U.S. PATENT DOCUMENTS

| | | | |
|---|---|---|---|
| 3,078,799 | 2/1963 | Kabik | 102/202.13 |
| 3,119,338 | 1/1964 | Pissacroia | 102/277.1 |
| 4,312,271 | 1/1982 | Day et al. | 102/202.14 |
| 4,694,755 | 9/1987 | Ibarra | 102/204 |
| 4,696,231 | 9/1987 | Bryan | 102/204 |
| 4,841,856 | 6/1989 | Gisler et al. | 102/202.13 |

FOREIGN PATENT DOCUMENTS

| | | | |
|---|---|---|---|
| 11613 | 4/1916 | United Kingdom | 102/204 |
| 731108 | 6/1955 | United Kingdom | 102/275.3 |

*Primary Examiner*—Deborah L. Kyle
*Assistant Examiner*—Stephen Johnson
*Attorney, Agent, or Firm*—Kalish & Gilster

[57] ABSTRACT

A delay detonator for causing actual detonation of a device a predetermined period of time following ignition as required by a wide variety of military and civilian operations. The detonator comprises a conventional primer, an expansion chamber separated by a screen from a first-fire combustion section, a delay column, two successive combustion sections separated by a screen, and a detonator output assembly.

6 Claims, 1 Drawing Sheet

DELAY DETONATOR

BACKGROUND AND SUMMARY OF THE INVENTION

This invention relates in general to the field of detonators, and generally to the detonation of any of a variety of devices by means of a strictly controlled explosive reaction.

Prior to the development of the present invention, detonators having a delay column have sometimes provided inconsistent delay periods and misfires believed to be due to incomplete, channelled and non-uniform combustion patterns down the length of the column.

It is, therefore, an object of the present invention to provide a delay detonation device for use in a wide variety of military and civilian applications.

It is a further object of the present invention to provide such a detonator which, as required for many applications, is characterized by a precise delay period between ignition and output.

It is also an object of the present invention to provide a delay detonator which is characterized by a delay column which substantially entirely accounts for the contribution of burn time comprising the detonation period.

It is a further object of this invention to provide a delay detonator wherein the period between ignition and output, being essentially entirely attributable to the delay column, is predictably and precisely controllable and variable by means of adjustments in the dimensions of the delay column.

Another object of the present invention is to provide a delay detonator with a delay column characterized by a high length/diameter aspect ratio and a precisely uniform, controlled combustion pattern which thereby provides consistently and accurately predictable and predetermined delay periods.

Briefly, this invention provides a delay detonator for causing output device detonation a predetermined delay period of time following ignition of the detonator. The detonator comprises a metal body, a primer fitted at an inner end of the body, a recess opening from the primer into an expansion chamber, a first-fire combustion section including first-fire ignition powder separated from the expansion chamber by a retention screen, a delay column proximate the first-fire combustion section including a delay powder composition to be ignited by the ignition powder, the delay column being of a relatively high length/diameter aspect ratio, a further combustion section including first-fire ignition powder for ignition by the delay column after a delay burn time thereof, and a detonator output assembly at the opposite, outer end of the body for ignition by the further combustion section.

Still further objects and features of the present invention will emanate from the drawings, description and claims.

DETAILED DESCRIPTION OF THE PREFERRED EMBODIMENT

Figure 1:
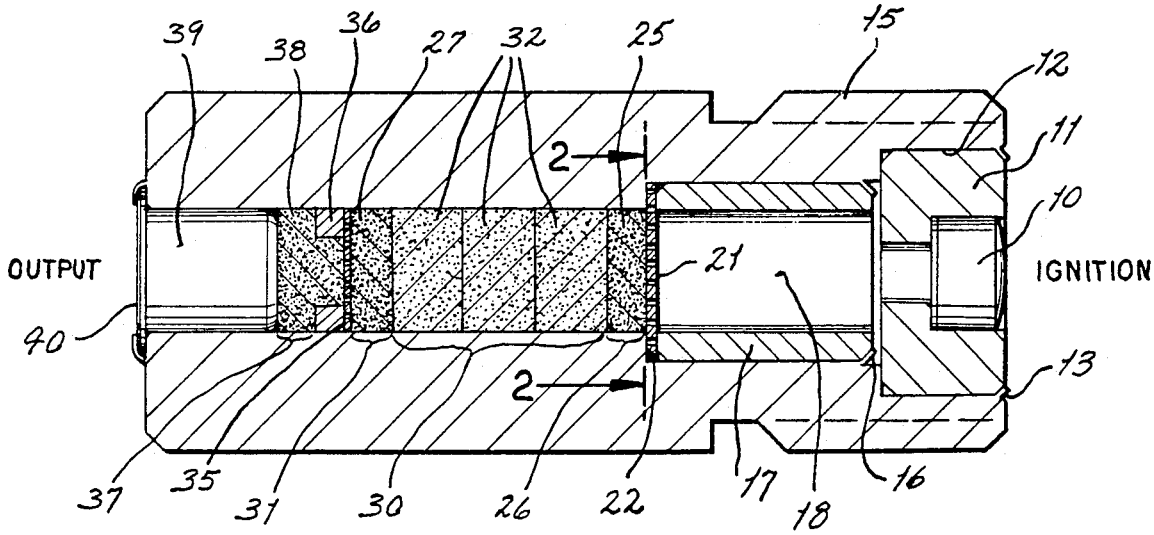
FIG. 1 is a longitudinal cross section of the delay detonator.
Figure 2:
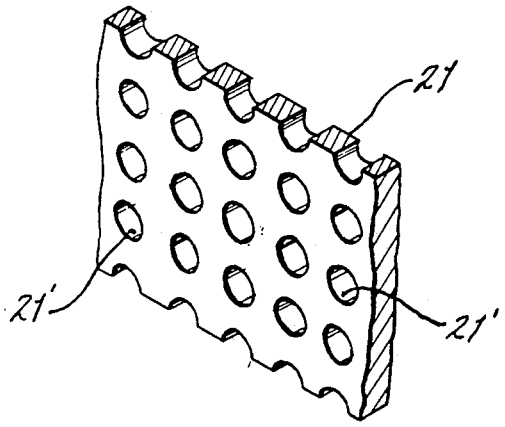
FIG. 2 is a perspective view of a section of the screen as taken across 2—2 of FIG. 1.

The delay detonator of the present invention will be described by referring to FIGS. 1 and 2 of the drawings.

The delay detonator has a standard primer assembly 10 confined within primer assembly holder 11 which is seated fast within a counterbore 12 of a detonator body 15 of suitable metal by means of epoxy adhesive applied to the full width and diameter of counterbore 12.

Annular crimp 13 encompassing the entire aft-most diameter of counter bore 12, is pressed into the aft surface of detonator body 15 and thereby further assists in retention of primer assembly holder 11.

Immediately forward of primer assembly holder 11 is an annular crimp 16 which rigidly supports retention sleeve 17.

A high strength retention sleeve 17 circumscribes and thereby geometrically defines expansion chamber 18. Sleeve 17 rigidly retains retention screen 21 against face 22 of counterbore in body assembly, being itself retained by crimp 16.

Screen 21, approximately 0.015 in. thick, for example, provides the high strength base necessary for the high pressure charging of the delay detonator during assembly.

The apertures 21' of screen 21, approximately 0.03 in. in diameter, for example, are preferably formed by being selectively etched from high temperature, high strength material plate such as stainless steel to allow passage of ignition gases from expansion chamber 18 into combustion section 26 while minimizing screen deflection upon combustion of conventional gasless ignition powder 25. The combustion products and effects are thereby appropriately confined to the detonator sections forward of screen 21, with relatively minimal realization aft of screen 21 of said combustion.

A first fire combustion section 26 contains gasless ignition powder 25 which is of increased reactivity such as to provide insubstantial burn time contribution relative to the preferred total detonation delay period.

Delay column 30 comprises three successive charges of known commercially available or military specification tungsten delay composition of approximately equal weight, for example, 175 grams, pressed at approximately equal pressures of, for example, 30,000 psi. The uniformity thereby provided prevents channelled combustion of the Tungsten Delay Composition 32 which, when allowed to occur, denies the detonator reliability and consistency. Delay column 30 also comprises a length/diameter aspect ratio of approximately 3:1, combustion of the contents of which thereby provides a consistently uniform combustion pattern which imparts an accurately predictable detonation delay critical in various applications.

Immediately forward of the delay column is a combustion section 31 which contains conventional gasless ignition powder 27 of increased reactivity so as to provide insubstantial burn time contribution relative to the preferred total detonation period of the delay detonator.

Screen 35, similar to screen 21, is similarly preferably apertured by being selectively etched from high strength, high temperature material plate such as stainless steel. Screen 35 is pressure-seated against gasless ignition powder 27 and rigidly supported by baffle 36.

A combustion section 37 contains gasless ignition powder 3 of increased reactivity so as to provide insubstantial burn time relative to the total detonation delay period. Baffle 36 facilitates direction of the desired explosive effect of combustion chamber 37 suitably toward output assembly 39 of known commercially available or military specification type such as will be known by those skilled in the art to be useful for detonation or ignition output purposes, which is seated against gasless ignition powder 38 and held within the detonator body assembly and therein sealed by a sealing disc 40.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A delay detonator for causing output device detonation a predetermined delay period of time following ignition of the detonator, comprising: a metal body, a primer fitted at an inner end of the body, a recess opening from the primer into an expansion chamber, a first-fire combustion section including first-fire ignition powder separated from the expansion chamber by a retention screen, a delay column proximate the first-fire combustion section including a delay powder composition to be ignited by the ignition powder, the delay column being of a relatively high length/diameter aspect ratio, a further combustion section including first-fire ignition powder for ignition by the delay column after a delay burn time thereof, and a detonator output assembly at an opposite, outer end of the body for ignition by the further combustion section; the delay column having a burn time which accounts substantially entirely for said predetermined delay period, being cylindrical in form and of constant diameter, and of a length/diameter aspect ratio of approximately 3:1, containing a tungsten delay composition, and being assembled by three successive charges of delay composition of essentially equivalent weight, loaded at equivalent pressures.

2. A detonator as recited in claim 1 wherein the screen is selectively etched stainless steel mesh.

3. A detonator as recited in claim 1 wherein the further combustion section comprises a first portion of first fire ignition powder proximate an outer end of the delay column and a second portion of first fire ignition powder proximate the output assembly, a further retention screen separating the first and second portions.

4. A detonator as recited in claim 3 wherein the further screen is selectively etched stainless steel mesh.

5. A detonator as recited in claim 4 wherein the primer-proximate screen is held rigidly in place by a retention sleeve extending a length of the expansion chamber.

6. A detonator as recited in claim 4 wherein the primer is carried by an assembly fitted into an aperture within the inner end of the body.

* * * * *